United States Patent [19]

Fottinger et al.

[11] Patent Number: 4,748,044

[45] Date of Patent: May 31, 1988

[54] METHOD FOR THE SIMULTANEOUS, CONTINUOUS BINDING AND COATING OF A NONWOVEN FABRIC

[75] Inventors: Walter Fottinger, Weinheim; Sepp Wagner, Gorrheimertal; Bohuslav Tecl, Weinheim; Werner Enders, Waldmichelbach, all of Fed. Rep. of Germany

[73] Assignee: Rma Carl Freudenberg, Heim/Bergstrasse, Fed. Rep. of Germany

[21] Appl. No.: 330,795

[22] Filed: Dec. 15, 1981

[30] Foreign Application Priority Data

Dec. 24, 1980 [DE] Fed. Rep. of Germany ..... 3049036
Dec. 24, 1980 [DE] Fed. Rep. of Germany ..... 3049037

[51] Int. Cl.[4] ..... B05D 3/06; B05D 5/00

[52] U.S. Cl. ..... 427/44; 427/54.1; 427/197; 427/288; 427/374.1

[58] Field of Search ..... 427/209, 211, 288, 194, 427/428, 44, 54.1, 197, 374.1

[56] References Cited

U.S. PATENT DOCUMENTS

| | | | |
|---|---|---|---|
| 3,978,789 | 9/1976 | Fennekels et al. | 101/211 |
| 4,062,989 | 12/1977 | Long | 427/176 |
| 4,291,087 | 9/1981 | Warburton | 428/288 |
| 4,339,566 | 7/1982 | Rosenkranz et al. | 528/68 |

*Primary Examiner*—Michael R. Lusignan
*Attorney, Agent, or Firm*—Kenyon & Kenyon

[57] ABSTRACT

A method is disclosed wherein a nonwoven fabric is synchronously coated with an adhesive composition and impregnated with a radiation cross-linkable binding agent under conditions that render the composition tacky and adherent but not penetrating and that cross-link the agent to at least in part bind the fibers of the fabric.

31 Claims, 2 Drawing Sheets

METHOD FOR THE SIMULTANEOUS, CONTINUOUS BINDING AND COATING OF A NONWOVEN FABRIC

BACKGROUND OF THE INVENTION

The invention relates to a method for the simultaneous, continuous interfiber bonding and coating of a nonwoven fabric with a bonding agent and an adhesive composition.

In European Patent Application No. 12776, a method is described for interfiber bonding of a nonwoven fabric by application of a UV-cross linkable bonding agent and subsequent irradiation with a high pressure mercury lamp. The application of an adhesive composition is not discussed.

A method for applying bonding agent and adhesive to a fabric is described in Japanese Provisional Patent No. 1667/1975. According to this patent, the bonding agent and the adhesive compositions are simultaneously applied while the fabric material is passed through a pair of gravure or screen cylinders. The resulting printing patterns obtained on both sides of the material are identical.

The known methods for applying bonding agent and adhesive composition simultaneously to the top and bottom sides of the fabric use an identical printing technique for the treatment of both sides. Relatively equal compression forces are produced by this technique, however, and it is extremely difficult to obtain different penetration levels of the bonding agent and adhesive composition. Relative variation of the size of the applied printed patterns is not possible, and higher printing speeds can lead, especially in the treatment of an unbonded nap of nonwoven fiber fabrics, to a smudged printing pattern and undefined properties of the fabric obtained.

These methods, therefore, do not comport with the intended purpose of the two applied substances. The primary purpose of a bonding agent is to bind the fibers of a nonwoven fabric to each other and to give it strength. Strength is increased by binding more fibers together. It is therefore desirable that the bonding agent penetrate into the interior of the treated nonwoven fabric and, after its incorporation, it should be substantially uniformly distributed over the entire cross-section.

In contrast, the adhesive compositions are applied to the surface of fabric material in order to enable bonding to another material. Typical adhesive compositions are thermoplastic substances, and the activation is accomplished through application of pressure and heat, for instance, with an iron. The adhesive composition should not penetrate into the interior of the fabric during the ironing in order to be available in as concentrated a form as possible for the subsequent bonding to the other material.

Therefore, it is an object of the invention to develop a method for the simultaneous, continuous application of a bonding agent and an adhesive composition onto opposite sides of an unbonded nonwoven fabric so as to obtain a precise application pattern on both sides with penetration by the former and substantially none by the latter. Further objects include development of the ability to vary the specific quantity of agent or composition applied and an ability to use high operating speeds during application. This permits a reduction in the energy requirements of the process.

SUMMARY OF THE INVENTION

These and other objects are achieved by the invention which is directed to a method for simultaneously coating a nonwoven fabric with an adhesive composition and binding it with a bonding agent. This method comprises applying a radiation-cross-linkable bonding agent to the underside of the fabric in the form of a first repeating pattern of first coverage units and synchronously applying against the agent a thermoplastic adhesive composition on the upper side of the fabric in the form of a second repeating pattern of second coverage units wherein each second unit is paired with a first unit and the centers of the paired first and second units are aligned.

The application of the composition is accomplished by a hot melt, powder dot or slurry screen printing method under the appropriate conditions and cross linking of the agent is subsequently accomplished by irradiation. Preferred methods of irradiation include UV and electron irradiation.

In general, the composition will be heated before or after application so that it becomes self adherent, adheres to the fabric and cannot be substantially dislocated upon or removed from the fabric by indirect physical means. The temperature of the heated composition will also be controlled so that the composition does not substantially penetrate the fabric substantially in fluid form. The extent and period of heating, the position in the application process that heating will occupy and the temperature control will depend upon the type of composition application method employed. These parameters all effectively produce composition tackiness and composition adherence to the fabric surface rather than fluidity. Temperature control limits heat input to the fabric so that the fabric coated with composition will not be of a high enough temperature for a sufficient period to cause penetration and fluidity of the composition.

When a hot melt method of composition application is employed, the fabric must be cooled after steps which heat the composition. These include cooling the coated fabric after application of hot, melted composition and if UV irradiation is employed, cooling after UV cross linking. Cooling after electron irradiation is not necessary.

When a powder dot method of dry composition application or a slurry screen method of composition paste application is employed, the composition must be of a particulate nature having a fine size. Thermal radiation of a limited intensity will be applied to the fabric coated with composition so that the composition particles self adhere and adhere to the fabric. This prevents dislocation of the particles. The size of the particles is chosen so that when the particle surfaces become tacky upon heating, the particles are rendered self adherent and fabric adherent. The intensity and period of thermal radiation is limited so that the composition particles are not rendered substantially fluid. Preferred particle sizes for use with the powder dot and slurry screen methods respectively are less than about 0.2 mm and less than about 0.1 mm. When UV irradiation is employed to cross link, the energy output of the UV generator is chosen so as to generate thermal radiation of the intensity indicated above. Essentially, this UV cross linking step also provides the heat to make the composition particles tacky and adherent to the fabric. The preferred ratio of thermal energy produced by the UV generator in relation to the total energy output of the generator is more than about 1:2. The period of exposure to and absolute intensity of the UV generator should be controlled such that the composition is not rendered fluid.

Crosslinking is preferrably performed instantly after application of binding agent and composition. Due to the single stage application of agent and composition, the method of the invention is not only substantially free of multistage difficulties but high operating velocities of fabric travel through the processing apparatus can be achieved with concurrent reduced energy consumption. Preferred velocities are from 50 to 150 m per min.

BRIEF DESCRIPTION OF THE DRAWINGS

The drawings illustrate examples of apparatus utilized to perform the process of the invention.

DETAILED DESCRIPTION OF THE INVENTION

Figure 3:
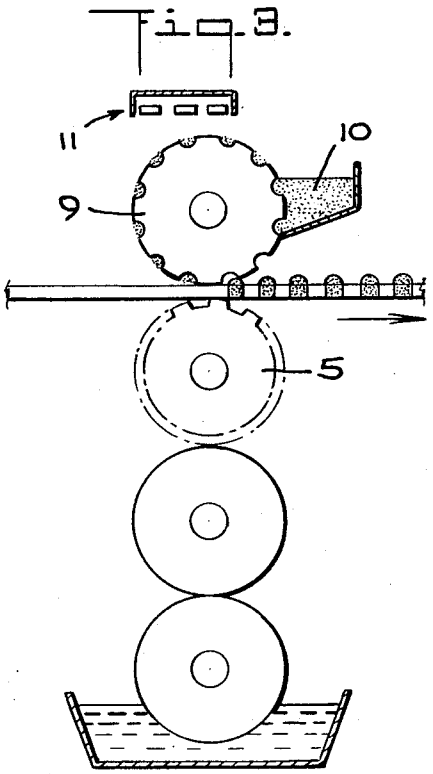
FIG. 3 shows a side view of a cylinder printing arrangement for binding agent and powdered composition dot application.

The process according to the invention, accomplishes synchronous application of binding agent and adhesive conditions to opposite sides of a nonwoven, unbonded, matted fabric wherein the binding agent is substantially distributed throughout the fabric and the adhesive composition substantially adheres to the fabric surface. The composition is heated under controlled condition so that it is adherent but not fluid enough to penetrate the fabric after it has been applied.

Prior binding of the fabric is not necessary. Rather, it is sufficient to compress and mix the fibers of the nonwoven fabric into a mat. A preferred mat form of the fabric will contain fibers of a staple length of at least 25 mm which are randomly distributed within the mat.

The composition and binder are printed onto opposite sides of the fabric in related patterns. The patterns comprise repeating first and second units of binder and composition covering the fabric which may have regular or irregular two dimensional shapes and sizes. Typically, these coverage units are dots, spots, circles, squares, stripes or irregularly shaped areas of composition or agent. The opposing first and second units are positioned as pairs so that the first unit lies directly and symmetrically over the second unit and the centers are aligned.

The relative sizes of the first and second units are variable and can therefore be adjusted without difficulty so that the differing purposes, namely the binding of the nonwoven fabric and thermal adhesive attachment to another material, can be optimally achieved according to the type of fabric, agent and composition being used. Since such optimization may require use of a pattern unit size adjustment device or different apparatus for each size adjustment, practical and economic aspects may outweight optimization of the relative sizes. It is therefore preferrable that the bonding agent units be of a size which is at least as large as that of the adhesive composition units. Exceptionally high substantial prevention of penetration of the adhesive into the fabric during processing and attachment to other material can be achieved if the coverage units of bonding agent have a larger size than the covering units of adhesive composition. The differences should not exceed 60% in order to prevent undesirable stiffening of the fabric.

The coverage units are distributed on and within the fabric according to a regular or irregular pattern. The pattern in turn, will determine the stiffening ability of the fabric and its textile drapability.

Typically, when the hot melt method of composition application is used, the fabric printed with a pattern of composition coverage units is cooled immediately after printing by passing it through a stream of cold air or over a cold fabric roller. The temperature of the air stream or roller will be cold enough to cool quickly the hot, melted composition. In this manner, the hot melted composition adheres to the fabric surface but is quickly cooled below its melting range so that it does not penetrate the fabric. Under this process variation, the bonding agent paste and the adhesive composition melt do not contain components which need to be removed by complicated subsequent drying processes.

Typically, when a powder dot or slurry screen method of composition application is used, the selection of radiation energy as described above ensures complete cross-linking of the bonding agent distributed in a pattern arrangement throughout the fabric while simultaneously causing adhesion of the particulate adhesive composition. A particularly advantageous ratio of UV and thermal radiation for this process prevails for medium and high pressure mercury UV lamps if these are directed toward both fabric surfaces and special filters and/or special cooling are not used. In practice, use of a high intensity energy distribution causes little composition melting to the extent that it penetrates because the intensity capable of being generated by such lamps and the velocity of fabric travel through the UV chamber render the fabric incapable of absorbing enough heat to melt the composition to a fluid state.

This high intensity of thermal radiation, preserves the contour sharpness of the printed pattern coverage units produced on both sides of the fabric. It is notable that contour sharpness is preserved and composition dislocation is prevented by this method even though mechanical vibrations or shock motions shake the bonded fabric during the processing. Typically, in the agent and composition application process, the suppression of vibration is often extremely difficult and the bonded fabric having an area weight range of 10 to 50 g/m$^2$ and a working width of more than 1 m, will react quite strongly to air vibrations.

The collander or cylinder printing operations used for applying the adhesive composition and the bonding agent to the fabric basically belong to different categories, each of which permits the agent and composition, which fulfill different tasks to be applied with a preferred mutual match. It is furthermore of substantial importance that of the two counter-rotating printing cylinders, at least one has soft-elastic properties. This arrangement adjusts for thickness or elasticity differences of the printed fabric so that disturbance of the printed patterns of agent and composition is prevented.

The bonding agent can be applied by means of a relief, flat or gravure cylinder with a soft-elastic jacket of rubber. With all three cylinder types, good penetration of the bonding agent into the interior of the nonwoven fabric is achieved. The relief printing process combines, in addition, the further advantage of a particularly high elasticity of the surface with good protection against contamination by fiber components separating from the surface of the printed fabric.

With the relief and flat printing process, the applied amount of bonding agent can be varied by continuously adjusting the printing device used. If a corresponding variation is required when a gravure printing process is used, a corresponding modified printing cylinder must be employed. Changed printing cylinders are also required if the size of the coverage units are to be modified in the relief, flat or gravure process.

The use of a bonding agent which can be cross-linked by UV radiation makes possible a nearly spontaneous cross-linking of the bonding agent due to the high energy density during the cross-linking. Because of the thermal energy produced, which preferrably is at least 50% of the total energy produced by the UV source, the fabric must be cooled immediately after irradiation when hot, melted composition has been applied. This will avoid composition fluidity and penetration. Typical methods are forced air cooling and rolling over a cold cylinder.

If a bonding agent is used which can be cross-linked by electron rays, further heating of the bonding agent does not taken place during the cross-linking. Instead, the hot melted adhesive composition is cooled against the fabric impregnated with the bonding agent at a temperature of, for instance, only 60° C., which produces instantaneous composition solidification and thereby leads to a printed pattern of a well defined outline.

The adhesive composition can also be printed on the nonwoven fabric in dry form as powder, using the powder dot method, or in the form of a paste-like aqueous suspension, using a screen printing process. In the screen process, it is necessary at a later stage of the process to remove the suspension carrier liquid by evaporation or suction. With the screen process, however, the amount of adhesive composition applied per area unit can be varied continuously by simply changing the setting angle of the screen wiper. With the powder dot process a new modified application roll is necessary. The powder dot method is therefor particularly useful for the manufacture of high volume, mass produced products having a constant amount of applied composition. The screen printing process is preferred for the production of small quantities of fabric having variable composition requirements.

The adhesive compositions can be formulated from polymers and other ingredients known in the art. Typical, known thermoplastic adhesives can be used. For example, such adhesives include such polyolefins, polyurethanes, copolyamides and copolyesters. The melting point of these adhesives will generally be in the range of about 75° to about 130° C.

If the adhesive composition used is printed in melted form with the aid of a heated cup cylinder, contamination of the cylinder surface is preferrably prevented by use of a silicone or a polytetrafluoroethylene coating.

The upper and the lower printing cylinders are connected by a gear, whereby a mutual correlation of the printed-on patterns of coverage units of bonding agent and adhesive composition is produced and maintained. The rigid coupling makes a mutual correlation of extremely high precision possible. In a typical cylinder gearing example, the centers of the coverage units printed on both sides of the fabric are completely aligned when working with a fabric width of more than 1 m and a coverage unit size of less than 1 mm. In common practice, the unit sizes will be from 0.4 to 0.7 mm and unit to unit distance on one fabric side will be from 0.1 to about 1 mm.

The process according to the invention will be explained in greater detail by the following examples which relate to the figures.

EXAMPLE 1

Hot Melt Composition, UV Method

By means of several longitudinally arranged carding machines, a fiber fabric of 25 g/m$^2$ of 50% polyester fibers 1.7 deltex per 38 mm and 50% polyester fibers 3.3 deltex per 60 mm was produced at a speed of 65 m/min. The fabric was conducted through a pair of rollers set against each other with a line pressure of 13 kg/cm, the surface temperature of which was 165° C., which matted the fabric by compression.

Figure 1:
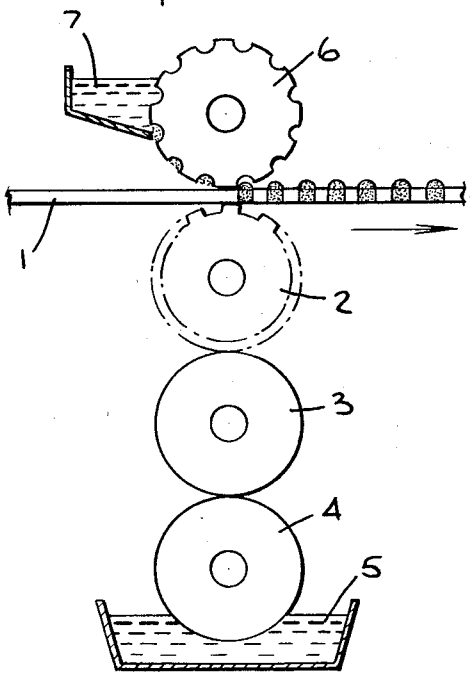
FIG. 1 shows side view of a cylinder printing arrangement for binding agent and hot, melted composition application.

Immediately following, the web of fabric was led through a printing device designed according to FIG. 1.

Lower printing cylinder 2 was a rubber relief-printing cylinder. The rubber was resistant to organic liquids and had a Shore-A hardness of 65. In two different printing runs, the pitch of the relief printing pattern was varied; first, a cylinder with a 17-mesh series point was used and second, a cylinder with a so-called computer point was used, in which 52 statistically distributed raises per cm$^2$ were provided. Associated with each of these two cylinders was a specially made hot-melt gravure cylinder with identical pitch.

The diameter of the printing areas of the relief printing cylinder was 0.8 mm and the gravure depth 0.4 mm.

From the tray with agent preheated to a temperature of 60° C., the binding agent comprised of a mixture of ingredients described below was transferred to rubber relief-printing cylinder 2 by immersion cylinder 4 of rubber and chrome-plated transfer cylinder 3 which was likewise heated to a temperature of 60° C. and was engraved with a 60-mesh gravure. The speed of immersion cylinder 4 was adjusted so that print application from the relief cylinder to the fabric of 2.5 g/m$^2$ resulted.

The two printing cylinders 2 and 6 were adjusted so that the centers of each pair of coincident opposing coverage units of bonding agent and adhesive composition were aligned.

The bonding agent mixture had the following composition:

| | |
|---|---|
| Expoxy acrylate | 70 parts |
| Oligotriacrylate | 30 parts |
| Benzophenone | 2 parts |
| Benzyldimethylketal | 1 part |
| N—methyl-diethanolamine | 3 parts |
| Optical brightener | 0.03 parts |

A copolyester was used as a hot melted adhesive. This polymer has a melting range of 113° to 116° C. and a melting index rate at 140° C. of 18 g/10 min. It was melted in an extruder having an exit end temperature of 175° C. and fed via a wide-slit nozzle to a similarly heated melted adhesive tray. The gravure cylinder had a temperature of 170° C.

The cup diameter of the gravure cylinder used in both runs was 0.55 mm and the cup depth 0.2 mm.

As it coated through the hot melt, the cups of the rotating gravure cylinder were filled with melted polymer from the melted-adhesive tray, which was transferred to the web of fabric. Synchronously with this operation, bonding agent was impressed into the interior of the fabric material from the underside by relief printing cylinder 2 having a temperature of 60° C., which caused spontaneous cooling-off and solidification of adhesive composition 7 printed on the top side. Adhesive composition was applied in an amount of 14 g per $m^2$ of fabric. Further treatment of the melted adhesive is not necessary.

After exit from the printing mechanism, the fabric was transported be means of a carrier belt of metal through a light lock and into an exposure box, where it traveled between two rows of high-pressure mercury lamps each having a power of 200 W/cm; one row shining on the top and the other shining on the bottom of the fabric. The bonding agent was cross-linked instantly. The fabric was transported out of the exposure box through a second light lock and passed over a cooling cylinder maintained at about room temperature which substantially prevented composition remelting and penetration. It was then cut into two webs of 90 cm finished width each and was rolled up.

The so produced thermo fixible interlining fabric is extremely soft and drapable and is highly resistant to chemical cleaning and extremely washable. It can be worked without problem on the customary flat and continuous presses and shows no tendency, even under heavy steam exposure, to back-cementing, i.e., penetration or bleeding of the adhesive composition back through the interlining fabric.

EXAMPLE 2

Screen Printing Paste Composition, UV Method

Figure 2:
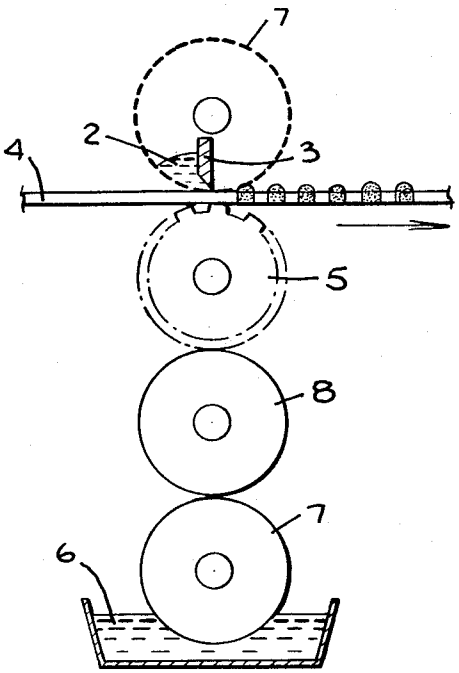
FIG. 2 shows a side view of a cylinder printing arrangement for binding agent and slurried composition paste application.

By means of several carding devices mounted in the longitudinal direction, a fiber fabric with a weight of 25 $g/m^2$, of 100% polyester fibers 1.7 dtex/40 mm was produced at a rate of 60 m/min. The fabric was conducted through a pair of cylinders which were set against each other and heated to a surface temperature of 150° C., and was matted by application of a line pressure of 15 kg/cm. Immediately thereafter the fabric was conducted through a printing device designed according to FIG. 2. The upper printing cylinder was screen printing stencil 1 with a 25-mesh raster. The hole diameter was uniformly 0.45 mm; the stencil thickness was 0.19 mm. In the screen printing cylinder, wiper 3 was arranged, the inclination of which to the vertical was adjustable.

Using screen printing cylinder 1, aqueous adhesive composition paste 2 was printed onto the fabric. The aqueous paste contained 40% by weight of powdered ternary copolyamide made from lauryllactam, caprolactam and AH-salt (a salt of adipic acid and hexamethylene diamine) having a maximum particle diameter of 10 to 80 microns and a melting point of 115° C. The paste was set to a viscosity of 15,000 m Pas sec with aqueous ammonia followed by addition of an acrylate thickener. The application amount of composition applied to the fabric was 30 $g/m^2$ wet, and 12 $g/m^2$ after drying.

Lower printing cylinder 5, i.e., the second cylinder from the top was a rubber relief-printing cylinder. The rubber was resistant to organic liquids and had a Shore-A hardness of 65. The pitch of the relief printing pattern was absolutely identical with that of the screen-printing cylinder, while the diameter of the printed coverage units was 0.8 m. The gravure depth was 0.4 mm.

From the tray with bonding agent, preheated to 60°, the bonding agent described below was transferred by immersion cylinder 7 of rubber and chrome plated transfer cylinder 8, which was likewise heated to 60° C. and was provided with 60-mesh engraving, to the rubber relief-printing cylinder. The speed of the immersion cylinder 8 was set so that the amount of agent applied from the relief-printing cylinder to the fabric was 2.5 $g/m^2$.

The two printing cylinders were set so that the centers of the opposing pairs of coincident coverage units printed on opposite sides were aligned.

The bonding agent was composed of a mixture of the following ingredients:

| | |
|---|---|
| Epoxy | 70 parts |
| Oligotriacrylate | 30 parts |
| Benzophenone | 2 parts |
| Benzyldimethylketal | 1 parts |
| N—Methyl-diethanolamine | 3 parts |
| Optical brightener | 0.03 parts |

After leaving the printing machine, the fabric was transported by means of a carrier belt of metal, through a light lock, into an exposure box, where it was conducted between two rows of high-pressure mercury lamps with a power of 200 watts/cm, one row shining on the top and the other shining on the bottom of the fabric. The bonding agent hardened instantly and the composition partially dried and rendered tacky so that it adhered to the fabric. The fabric left the exposure box through a second light lock and was thereupon conducted through a tenter frame 15 m long, in which the adhesive composition was fully dried and sintered in an ambient air temperature of 115° C.

After passing through the tenter frame, the fabric was cut and separated by means of cutting devices so that two portions of directly salable interlining fabric 90 cm wide were produced.

The interlining fabric produced in this manner is very soft and drapable, has excellent washing and dry-cleaning resistance and can be easily processed on all conventional garment cementing devices.

EXAMPLE 3

Powder Dot Composition, U V Method

By means of several carding machines mounted transversely to the machine travel direction and by means of crosslaying devices, a transversely placed fabric was deposited on a slat table. The area weight of the fabric web running at this speed was 27 $g/m^2$ and the web width was 195 cm. The fiber mixture consists of:

Highly curled polyamide fiber 1.7 deltex/40 mm cut length 40 parts

Highly curled polyamide fiber 3.3 deltex/51 mm cut length 30 parts

Polyester fiber 1.6 deltex/40 mm cut length 30 parts

The fabric was then conducted through a pair of heated cylinders as described in Example 2 in order to mat it. The surface temperature of the cylinders was 190° C., the line pressure is 30 kg/cm and the circumferential velocity 25 m/min.

Immediately after passing through the heated cylinders the fabric was conducted through a printing device designed according to FIG. 3.

The lower 3 cylinders together with the agent tray were identical with those described in Example 2; the composition of the binding agent and its temperature, as well as the cylinder heating of the transfer cylinder were also the same. The top cylinder was designed as powder dot application cylinder 9. The printed pattern was a 25-mesh series dot. Its pitch was absolutely identical with the 25-mesh raster of the relief-printing rubber cylinder 5 underneath. The coverage units, with similar circular shape, had a diameter of 0.8 mm. The gravure depths of the depression were 0.25 mm and their diameter was 0.40 mm.

The powder cylinder was heated to a surface temperature of 68° C. A ternary copolyamide powder 10 with a maximum particle diameter of 1 to 200 micron and a melting range of 120 to 130° C. was applied thereby in an amount of 15 g/m$^2$.

Simultaneously and coinciding with the same points on fabric topside, 3 g/m$^2$ of the UV-hardenable bonding agent described in Example 2 was applied from below by means of the relief-printing cylinder 5 of rubber. After leaving the printing mechanism, the fabric ran through the exposure box described in Example 2, wherein the bonding agent was hardened and the dots of adhesive composition rendered adherent. The partially precemented adhesive composition was then finally sintered solid in a subsequent infrared section (radiator temperature 400° C.). After passing a cooling cylinder, maintained about ambient temperature, which substantially prevented composition melting and penetration, the web of material was cut, as in Example 2, into two portions of 90 cm finished width each.

A particularly soft multidirectional interlining fabric of high bulk, good drapability and excellent resistance to washing and dry cleaning is produced according to this example.

The circular coverage units of bonding agent have a larger diameter than the coverage units of adhesive composition in these examples. The adhesive composition, which melts when the fabric is thermally fixed as an interlining insert in a garment, is thereby essentially prevented from penetrating back into the interlining fabric. Although the opposing coverage units may have the same diameters, the foregoing relation is preferred because back penetration is better prevented. In addition to the described regular area rasters, the partial areas can be applied in any other desired area raster, for instance, also in the frequently preferred random raster with statistical orientation. In addition to the round shape of the units, any other shape is also possible.

What is claimed is:

1. A method for the continuous, synchronous binding and coating of a non-woven fabric, respectively with a radiation cross-linkable binding agent and with a thermoplastic adhesive composition, which comprises:
   - applying the agent as a fluid to the fabric lower side and distributing the agent throughout the fabric;
   - applying synchronously with the agent application, the composition as a solid coating on the surface of the fabric upper side, the agent and composition applications being made as overlapping patterns;
   - irradiating the fabric impregnated with agent and coated with composition to cause agent cross-linking, wherein the irradiation source used also produces thermal radiation of an amount sufficient to render the composition tacky and fabric adherent, and
   - heating the composition with the thermal radiation to cause the composition to become tacky and fabric adherent but substantially prevent it from attaining a fluid state on the fabric which would affect substantial penetration of the composition into the fabric, thereby producing the bonded, coated non-woven fabric.

2. A method for the continuous, synchronous binding and coating of a non-woven fabric, respectively with a radiation cross-linkable binding agent and with a thermoplastic adhesive composition, which comprises:
   - applying the agent as a fluid to the fabric lower side and distributing the agent throughout the fabric;
   - applying synchronously with the agent application, the composition as a tacky, substantially non-fluid coating to the surface of the fabric upper side, said composition being heated to a temperature which renders it tacky and fabric adherent but substantially non-fluid before it is applied to the fabric, and the agent and composition applications being made as overlapping patterns;
   - irradiating the agent impregnated, composition coated fabric to produce agent cross-linking; and
   - maintaining the fabric at a temperature which will substantially cool the composition rendering it substantially solid and preventing it from attaining a fluid state on the fabric which would affect its substantial penetration into the fabric, thereby producing the bonded, coated non-woven fabric.

3. A method according to claim 1 wherein the composition is applied by an aqueous slurry screen method or a powder dot method.

4. A method according to claim 2 wherein the composition is applied by a hot melt method.

5. A method according to claim 2 comprising cooling the composition coated, agent impregnated fabric by convection, conduction or radiative means so that melting of the composition on the fabric is substantially prevented.

6. A method according to claim 5 comprising cooling the agent impregnated, composition coated fabric by a cold air stream or a cold roller cylinder immediately after application of the hot, melted composition.

7. A method according to claim 6 comprising cooling the fabric a second time by a cold air stream or a cold roller cylinder after irradiating.

8. A method according to claim 2 wherein U.V. or electron irradiation is used.

9. A method according to claim 2 wherein U.V. irradiation is used.

10. A method according to claim 8 using electron irradiation from a source having a power of about 50 to 500 kV.

11. A method according to claim 1 wherein the composition is applied as a fine particulate paste in water by an aqueous slurry screen method or a dry, fine particulate by a powder dot method and the irradiation energy source produces a thermal irradiation energy portion which is sufficient to cause paste or particulate tackiness and its fabric adherence.

12. A method according to claim 11 wherein the composition particle size is less than about 0.2 mm.

13. A method according to claim 2 wherein U.V. or electron irradiation is used.

14. A method according to claim 2 wherein U.V. irradiation is used.

15. A method according to claim 14 wherein at least about 50% of the energy produced by the U.V. source is thermal radiation.

16. A method according to claim 14 wherein the U.V. irradiation is produced by a mercury gas discharge lamp of a power of at least 80 W per cm.

17. A method according to claim 1 wherein the patterns of bonding agent and composition comprise repeating units, the agent units being at least as large as the composition units.

18. A method according to claim 17 wherein the agent units are larger than the composition units.

19. A method according to claim 17 wherein the agent and composition units are coincident.

20. A method according to claim 17 wherein the agent and composition unit patterns have a regular or irregular surface raster.

21. A method according to claim 2 wherein the patterns of bonding agent and composition comprise repeating units, the agent units being at least as large as the composition units.

22. A method according to claim 21 wherein the agent units are larger than the composition units.

23. A method according to claim 21 wherein the agent and composition units are coincident.

24. A method according to claim 21 wherein the agent and composition unit patterns have a regular or irregular surface raster.

25. A method according to claim 1 wherein the composition has a melting range of about 75° to 130° C.

26. A method according to claim 2 wherein the composition has a melting range of about 75° to 130° C.

27. A method according to claim 2 wherein the fabric is maintained at a temperature at least about 15° C. lower than the melting temperature of the composition.

28. A method for the continuous, synchronous binding and coating of a non-woven fabric, respectively with an irradiation cross-linkable binding agent and with a thermoplastic adhesive composition, which comprises:

applying the agent as a fluid to the lower side of the fabric, said agent being in a fluid state at a temperature of no more than about 60° C. and said agent distributing substantially throughout the fabric;

applying simultaneously with the application of the binding agent, the adhesive composition selected from the group consisting of polyolefins, polyurethanes, copolyamides and copolyesters, to the upper side of the fabric, said composition being at a temperature of about 75° C. to about 130° C., being tacky but non-fluid and adhering to the surface of the fabric as a coating but not penetrating therein; the application of composition and agent being made with overlapping patterns;

irradiating the fabric coated with composition and impregnated with agent, using ultraviolet light to cause agent cross-linking, and maintaining the temperature of the fabric at no more than about 60° C., thereby producing the bonded, coated fabric.

29. A method according to claim 28 comprising cooling the fabric after application of the hot melt composition.

30. A method according to claim 29 comprising cooling the fabric a second time after irradiation.

31. A method according to claim 30 wherein cooling is achieved by a cold air stream.

* * * * *

UNITED STATES PATENT AND TRADEMARK OFFICE

CERTIFICATE OF CORRECTION

PATENT NO. : 4,748,044

DATED : May 31, 1988

INVENTOR(S) : FOTTINGER et al.

It is certified that error appears in the above-identified patent and that said Letters Patent is hereby corrected as shown below:

Title page, under [73] Assignee, replace "Rma" by --Firma--., and "Heim" by --Weinheim--.

Column 2, lines 26-27, replace "dis-clocated" by --dis-located--.

Column 4, line 54, replace "collander" by --calender--.

Column 5, lines 18 and 60, replace "preferrably" by -- preferably--.

Column 5, line 45, replace "therefor" by --therefore--.

Column 5, lines 52-53, replace "Typical" by --Typi-cally--.

UNITED STATES PATENT AND TRADEMARK OFFICE

CERTIFICATE OF CORRECTION

PATENT NO. : 4,748,044

DATED : May 31, 1988

INVENTOR(S) : FOTTINGER et al.

It is certified that error appears in the above-identified patent and that said Letters Patent is hereby corrected as shown below:

Column 7, line 1, replace "it coated" by --coated--.

Column 8, line 21, replace "1 parts" by --1 part--.

Column 8, lines 56, 58 and 60, replace "deltex" by --dtex--.

Column 9, line 15, replace "micron" by --microns--.

Signed and Sealed this

Twenty-eighth Day of March, 1989

*Attest:*

DONALD J. QUIGG

*Attesting Officer*

*Commissioner of Patents and Trademarks*